US009004457B2

(12) United States Patent
Carl

(10) Patent No.: US 9,004,457 B2
(45) Date of Patent: Apr. 14, 2015

(54) PORTABLE HAND RAIL FOR BOAT DOCKS

(71) Applicant: Cloyde Lynn Carl, Montezuma, IA (US)

(72) Inventor: Cloyde Lynn Carl, Montezuma, IA (US)

( * ) Notice: Subject to any disclaimer, the term of this patent is extended or adjusted under 35 U.S.C. 154(b) by 266 days.

(21) Appl. No.: 13/851,655

(22) Filed: Mar. 27, 2013

(65) Prior Publication Data

US 2014/0291596 A1 Oct. 2, 2014

(51) Int. Cl.
*E04F 11/18* (2006.01)
*E01D 19/02* (2006.01)

(52) U.S. Cl.
CPC ..... *E01D 19/02* (2013.01); *E04F 11/1865* (2013.01); *E04F 11/1812* (2013.01)

(58) Field of Classification Search
CPC ..... E04G 21/3242; E04G 21/3233; E04G 21/3223; E04F 11/1812; E04F 11/1865; E01D 19/02; Y10T 403/67; Y10T 403/68; Y10T 403/7009; Y10T 403/7067; Y10T 403/76
USPC ..... 256/67, 68, 69, 70, 65.14, 1, DIG. 6; 182/113; 248/229.21, 231.31
See application file for complete search history.

(56) References Cited

U.S. PATENT DOCUMENTS

| | | | | | |
|---|---|---|---|---|---|
| 4,235,409 | A * | 11/1980 | Cummings | 248/538 |
| 4,236,698 | A | 12/1980 | Compte | |
| 4,243,207 | A | 1/1981 | Heykants | |
| 5,369,921 | A | 12/1994 | Glenn | |
| 5,685,517 | A * | 11/1997 | Salibra | 248/519 |
| 5,699,875 | A * | 12/1997 | Dugan | 182/3 |
| 6,283,457 | B1 | 9/2001 | Venegas | |
| 8,708,099 | B2 * | 4/2014 | Fortin | 182/3 |
| 2003/0015696 | A1 | 1/2003 | Watson | |
| 2007/0117442 | A1 | 5/2007 | Melic | |
| 2012/0080655 | A1 | 4/2012 | Coffin | |
| 2012/0102853 | A1 * | 5/2012 | Rizzo | 52/173.3 |

* cited by examiner

*Primary Examiner* — Michael P Ferguson
*Assistant Examiner* — Matthieu Setliff
(74) *Attorney, Agent, or Firm* — Sturm & Fix LLP

(57) ABSTRACT

A portable, universal, hand rail apparatus that can be easily and quickly attached or detached to any dock that has cracks between adjacent dock boards.

6 Claims, 3 Drawing Sheets

Fig. 7
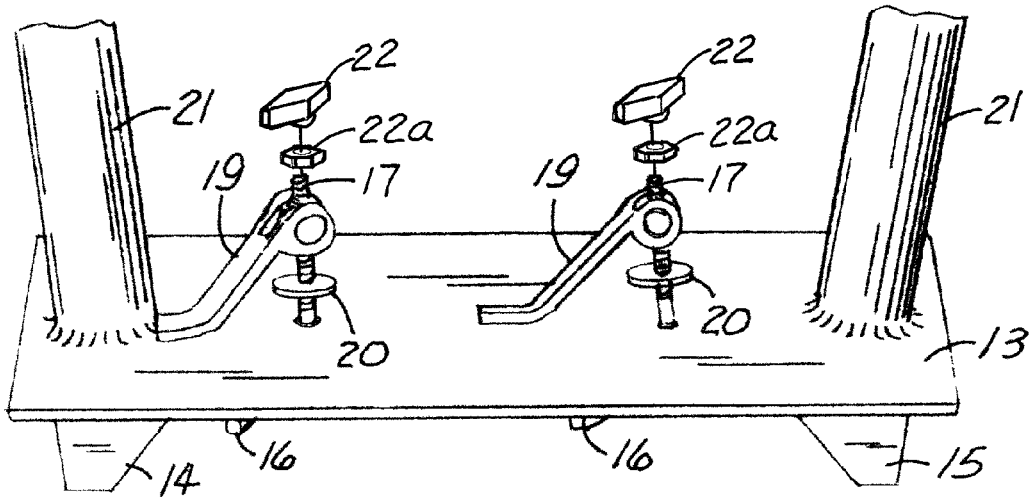
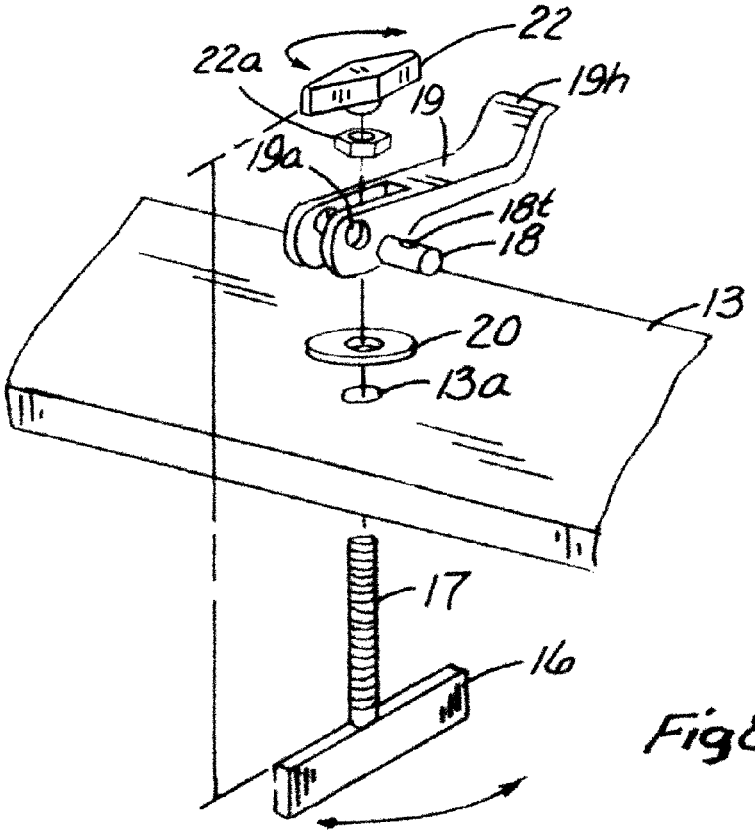
Fig8

PORTABLE HAND RAIL FOR BOAT DOCKS

TECHNICAL FIELD

This invention relates generally to a hand rail for use on boat docks and more particularly to a universal one that can be easily attached and detached to any dock that has cracks between adjacent dock boards.

BACKGROUND

Many boat docks do not have hand rails for providing stability for a person getting onto or off from a boat tied up at a dock. Part of the problem of installing hand rails is that the best place for them to be can change depending upon the size of the boat or where the boat is with respect to the dock at the time that a person wants to get on or off of the boat.

Often people go on fishing trips for days or weeks in places far from home. These people usually do not know the dock configuration before they arrive at their destination. So if they want to use a hand rail for getting between a boat and the dock, it is not a reasonable option to ask the dock owner to install a permanent one.

Accordingly, there is a need for a way to provide portable dock rails that can be used almost anywhere and which will not damage the dock itself during installation, use or removal.

BRIEF DESCRIPTION OF THE DRAWINGS

The above needs are at least partially met through provision of the method and apparatus described in the following detailed description, particularly when studied in conjunction with the drawings, wherein:

FIG. 7 is an enlarged perspective view from the top showing over center cams which can be threadably adjusted to accommodate dock boards of different thicknesses and yet quickly attached or disconnected when desired; and FIG. 8 is an enlarged view of one of the cam members, showing how the preferred embodiment works in combination with a flange member having a threaded member on it that threads into the axle pin of the over center lever of the cam member.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
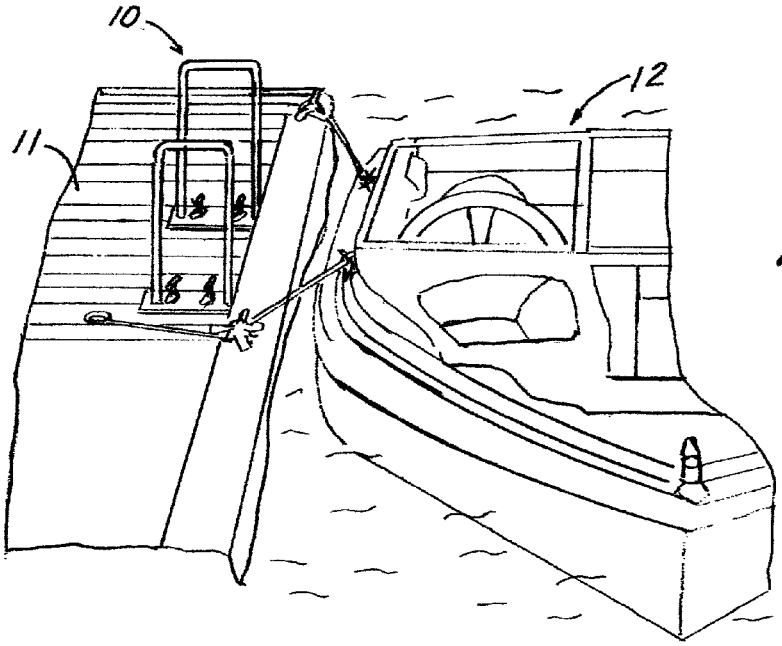
FIG. 1 is a perspective view of a boat tied to a boat dock and having portable rails of the present invention attached to the boat dock to allow a person to hold on to the rails while moving between the boat and the dock.
Figure 2:
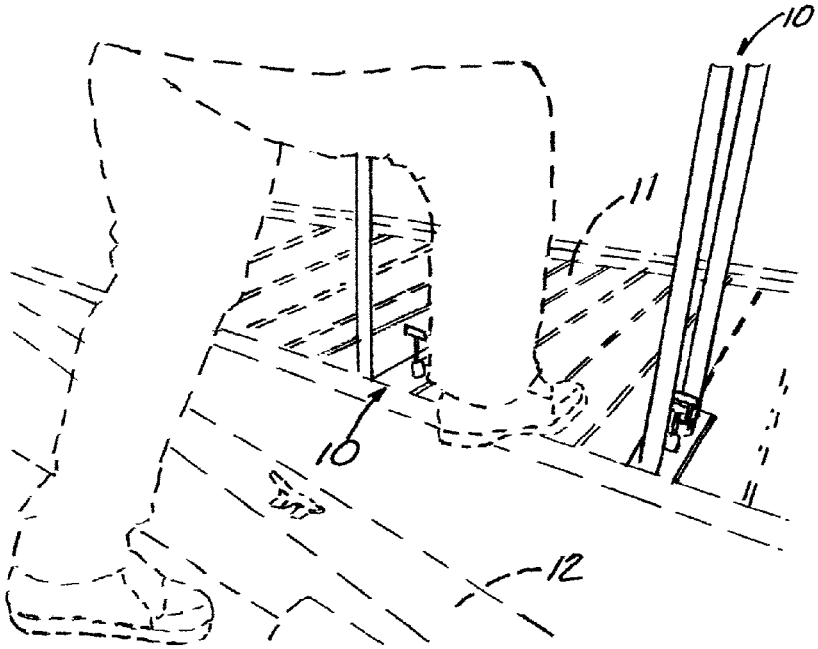
FIG. 2 is another perspective view of a person, shown in dashed lines, stepping from a boat to a dock between two of the rails of the present invention attached to the dock.
Figure 3:
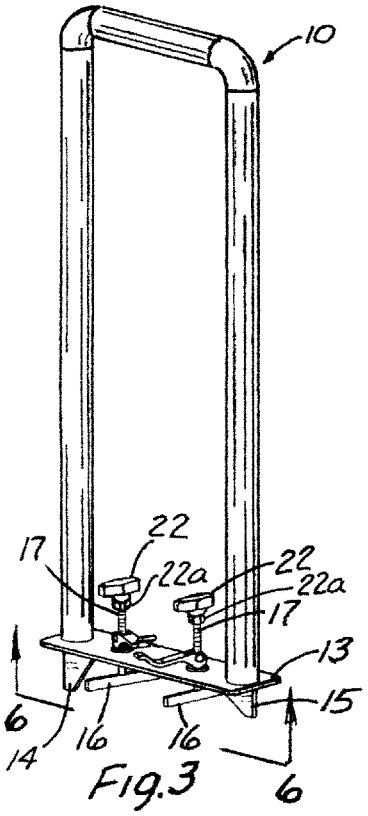
FIG. 3 is a perspective view of one of the portable rails of the present invention shown separated from a dock an flanges turned to the pivotal position they would be in when attached to a boat dock.
Figure 4:
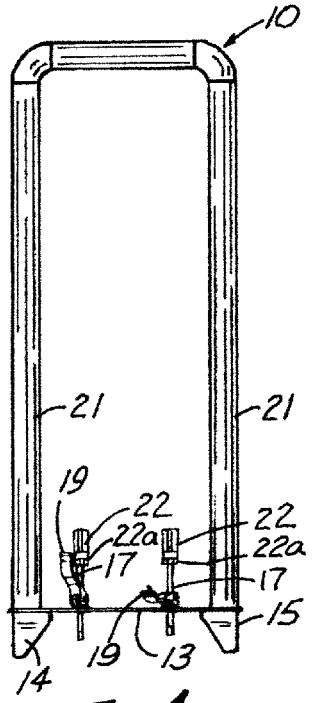
FIG. 4 is a side elevational view of the portable rail of FIG. 3 with the flanges turned to a position they would be in during installation wherein the flanges could pass through cracks between dock boards.
Figure 5:
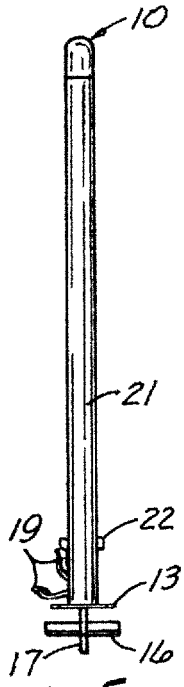
FIG. 5 is an end elevational view of the portable rail of FIG. 3 with the flanges turned to a position they would be in when attached to a dock.

Referring now to the drawings, wherein like reference numerals indicate identical or similar parts throughout the several views, FIGS. 1 and 2 show the portable hand rails 10 shown attached to a dock 11 that has a boat 12 tied thereto.

Each of the hand rails 10 have a plate 13 with a U-shaped rail 20 attached thereto, such as by welding for example.

The plate 13 has a pair of flanges 14 and 15 welded to the underside thereof that are aligned along a vertical plan so that they can slide between dock boards on a typical boat dock. Of course they could be attached in other ways. The plate 13 has a pair of apertures 13*a* disposed there through as can be seen best in FIG. 8.

Threaded members 17 extend through the apertures 13*a*, through washer 20, and is threaded into a threaded opening 18*t* in pin 18 while pin 18 is disposed in the openings 19*a* of cam 19. The bottom of each threaded member 17 has a moveable flange 16 on it. Directional indicator knobs 22 are optionally threadably attached to the top of threaded members 17 for reasons which will be discussed below.

Looking to FIGS. 7 and 8, a jam nut 22*a* is threaded onto each threaded member 17 followed by threading the directional knob 22 onto the shaft 17. The purpose of the directional indicator knobs 22 is to be able to tell the position of flange 16 even when it is out of sight under the dock 11. So before installation, each directional indicator knob 22 is threaded onto the threaded shaft 17 so it is in alignment with the flange 16. After that, the jam nut 22*a* is screwed in a direction to go upwardly into abutment with the directional indicator knob 22 to hold it firmly in the position selected. Essentially a plane extending through the moveable flange 16 will extend through the widest part of the directional indicator knob 22 that is shown. If a symmetrical knob was to be used instead of the directional indicator knob 22, then a line or other indicia could be placed on such round knob to be aligned with the flange 16 to indicate to the user the position of the moveable flange 16 when it is out of sight under dock boards.

Figure 6:
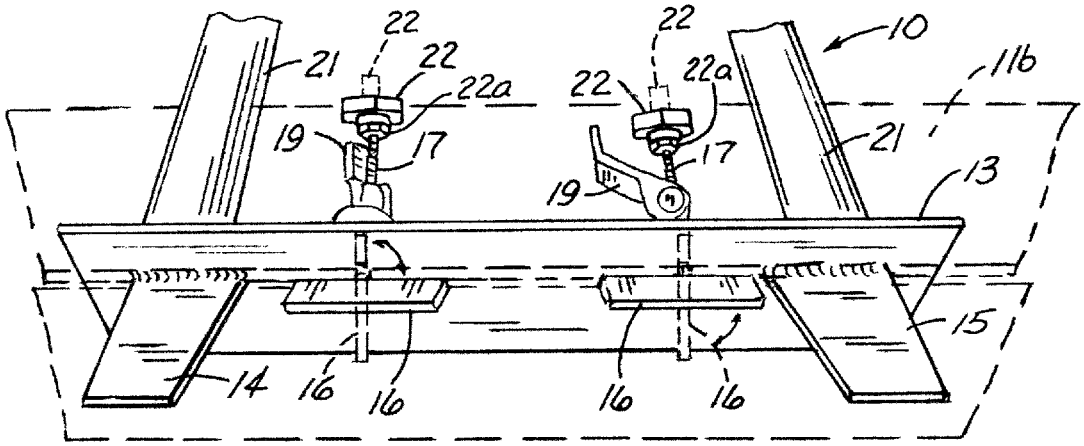
FIG. 6 is an enlarged perspective view of the portable rail shown during installation to a dock when the flanges are turned to the FIG. 4 position and moved from above the dock boards to a position below the dock boards, the directional arrows showing how the flanges can be turned 90 degrees from the position shown to the FIG. 3 in a later step to connect the portable rail to the dock.

Looking to FIGS. 3-8, to use the portable hand rails 10 the moveable flanges 16 would be aligned with the fixed flanges 14 and 15 so that the these flanges 14-16 can be pushed down between adjacent boards 11*a* and 11*b* of dock 11 as shown in FIG. 6. The next step for the installation to put the hand rails 10 in the position shown in FIGS. 1 and 2, would be to turn the threaded rod 90 degrees from the position shown in FIG. 6 to the position shown in FIGS. 3 and 8, using the directional indicator knobs 22 as an indication of when the flanges 16 are in the position shown in FIGS. 3, 5 and 8 in solid lines and in the position in dashed lines as shown in FIG. 6, noting that the knob 22 in dashed lines in FIG. 6 is also turned 90 decrees from the solid line position thereof.

Then, while pulling up on the directional indicator knobs 22 and thereby on threaded members 17 while the moveable flange 16 against the bottom of the dock boards 11*a*/11*b*, the pin 18 of the cam handle 19*h* would be turned sort of like you would thread a nut (like the threaded pin 18) onto a bolt (like the pin 17). This would be done by turning the handle 19*h* while in the up position, kind of like using a wrench and spinning the cam 19 around the threaded rod 17 in a rotary direction to move the rod 17 and flange 16 upwardly until it is tightened to the dock board thickness generally. After that, the handle 19*h* is just pushed down about the longitudinal axis of pin 18 to cause the final tightening of the flange 16 against the bottom of the boards 11*a*/11*b*. In this way, the boards 11*a*/11*b* are clamped tightly between the flange 16 and the plate 13.

Once one side is clamped, i.e. the boards are clamped between one flange 16 and the plate 13, the same procedure is used to tighten and clamp the boards 11*a*/11*b* between the other moveable flange 16 and the other half of the plate 13. This will produce the hand rail structure 10 shown in FIGS. 1 and 2, noting that two hand rails 10 can be used instead of just one if desired.

FIG. 2 shows a person in dashed lines moving from the boat 12 to the dock 11 while using the handrails 10, by grasping the top parts 20 of the handrails 10. Obviously the handrails 10/20 can be used to go from the dock 11 to the boat 12 in the same manner.

Once the user of the handrails 10 decides not to use them on the dock 11 anymore, the user merely reverses the installation steps described above to remove the handrails 10 from the dock 11. For example if the user were to go on a fishing trip for a week, then the portable handrails 10 could be used on a dock where the user is boating/fishing, whether using the user's own boat or someone else's boat. But then when the vacation is over, the handrails 10 can be removed from the dock and taken home for storage and be ready for a future use at a different location. Because the handrails 10 do not harm the dock itself, there should be no objection by the dock owner to their use.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

The invention claimed is:

1. A portable hand rail apparatus for boat docks comprising:

a plate disposed generally in a horizontal plane, at least one opening through the plate;

a first fixed flange operatively rigidly attached to the plate, the first fixed flange being disposed generally in a vertical plane;

a first threaded member disposed through the hole in the plate;

a first moveable flange operatively rigidly attached to a bottom end of the first threaded member, the first moveable flange having at least a first position disposed generally in the vertical plane and a second position transverse to the vertical plane wherein the first fixed flange and the first moveable flange can pass through a narrow space between two dock boards in the first position of the first moveable flange and wherein the first fixed flange and first moveable flange cannot both pass between the narrow space between the two dock boards in the second position thereof;

a first pin disposed above the plate, the pin being disposed along an axis substantially parallel to the horizontal axis, the first pin also having a vertical threaded opening;

the first threaded member being threadably disposed in the threaded opening through the first pin whereby the distance between the first pin and the first moveable flange is adjustable by rotating the threaded member about a vertical axis of the first threaded member with respect to the first pin;

a first cam member operatively pivotally attached to the first pin, the first cam being rotatable about a longitudinal axis of the first pin, the longitudinal axis of the first pin being generally parallel to the horizontal axis, the first cam member having a first pivotal position defining a first distance between the horizontal axis and the longitudinal axis of the first pin and a second pivotal position defining a second distance between the horizontal axis and the longitudinal axis of the first pin, the second distance being greater than the first distance, whereby when the first cam is moved from the first to the second position thereof the first moveable flange will be pulled upwardly towards the bottom of the dock boards thereby causing the plate and first moveable flange to be closer together to thereby clamp the plate securely to the dock; and a handrail operatively rigidly attached to the plate, the handrail being disposed generally upwardly from the plate to a substantial distance above the plate high enough to be grasped by a boater moving between the dock and a boat alongside the dock.

2. The portable hand rail apparatus for boat docks of claim 1 further comprising:

a second opening through the plate;

a second fixed flange operatively rigidly attached to the plate, the second fixed flange being disposed generally in said vertical plane;

a second threaded member disposed through the second hole in the plate;

a second moveable flange operatively rigidly attached to a bottom end of the threaded member, the second moveable flange having at least a first position disposed generally in the vertical plane and a second position transverse to the vertical plane wherein the second rigid flange and second flange can pass through a narrow space between two dock boards in the first position of the second moveable flange and wherein the second rigid flange and second flange cannot pass between the narrow space between the two dock boards in the second position thereof;

a second pin disposed above the plate, the second pin being disposed along an axis substantially parallel to the horizontal axis, the second pin also having a second vertical threaded opening;

the second threaded member being threadably disposed in the threaded opening through the second pin whereby the distance between the second pin and the second moveable flange is adjustable by rotating the second threaded member about a vertical axis of the second threaded member with respect to the second pin;

a second cam member operatively pivotally attached to the second pin, the second cam being rotatable about a longitudinal axis of the second pin, the longitudinal axis of the second pin being generally parallel to the horizontal axis, the second cam member having a first pivotal position defining a first distance between the horizontal axis and a longitudinal axis of the second pin and a second pivotal position defining a second distance between the horizontal axis and the longitudinal axis of the second pin, the second distance between the horizontal axis and the longitudinal axis of the second pin being greater than the first distance between the horizontal axis and the longitudinal axis of the second pin, whereby when the second cam is moved from the first to the second position thereof the second moveable flange will be pulled upwardly towards the bottom of the dock board thereby causing the plate and second moveable flange to be closer together to thereby clamp the plate securely to the dock.

3. The portable hand rail apparatus for boat docks of claim 1 further comprising a washer disposed around the first threaded member, the washer being disposable between the first cam and a top surface of the dock boards.

4. The portable hand rail apparatus for boat docks of claim 1 further comprising a directional indicator operatively attached to a top end of the first threaded member for indicating the position of the moveable flange even when the moveable flange is out of sight under dock boards.

5. The portable hand rail apparatus for boat docks of claim 2 further comprising a second washer disposed around the second threaded member, the second washer being disposable between the second cam and the top surface of the dock boards.

6. The portable hand rail apparatus for boat docks of claim 2 further comprising a directional indicator operatively attached to a top end of the first threaded member for indicating the position of the moveable flange even when the moveable flange is out of sight under dock boards.

* * * * *